US006322267B1

(12) United States Patent
Shaffer-Bauck

(10) Patent No.: US 6,322,267 B1
(45) Date of Patent: Nov. 27, 2001

(54) ADJUSTABLE CRAYON HOLDER

(76) Inventor: James C. Shaffer-Bauck, P.O. Box 490, 658 North Beach Rd., East Sound, WA (US) 98245

( * ) Notice: Subject to any disclaimer, the term of this patent is extended or adjusted under 35 U.S.C. 154(b) by 0 days.

(21) Appl. No.: 09/788,926

(22) Filed: Feb. 21, 2001

(51) Int. Cl.[7] ..... B43K 17/00; B43K 21/08; B43K 23/016

(52) U.S. Cl. ..... 401/62; 401/75; 401/82; 401/88; 401/99

(58) Field of Search ..... 401/62, 63, 64, 401/55, 56, 82, 95, 99, 88; 15/436, 435

(56) References Cited

U.S. PATENT DOCUMENTS

| | | | | |
|---|---|---|---|---|
| 202,654 | * | 4/1878 | Holland | 401/82 |
| 272,948 | * | 2/1883 | Fiske | 401/82 |
| D. 276,537 | | 11/1984 | Tabachnik . | |
| 394,053 | * | 12/1888 | Boman | 401/62 |
| 394,054 | * | 12/1888 | Boman | 401/62 |
| 4,468,146 | | 8/1984 | Tabachnik . | |
| 5,002,182 | | 3/1991 | McGinnis . | |
| 5,044,805 | * | 9/1991 | Kosteniuk et al. | 401/82 |
| 5,048,989 | | 9/1991 | Stageman . | |
| 5,477,983 | | 12/1995 | Davis . | |
| 5,490,738 | | 2/1996 | Pearce . | |

FOREIGN PATENT DOCUMENTS

| | | | | |
|---|---|---|---|---|
| 3618602 | * | 12/1987 | (DE) | 401/88 |

* cited by examiner

*Primary Examiner*—Gregory L. Huson
*Assistant Examiner*—Kathleen J. Prunner
(74) *Attorney, Agent, or Firm*—William P. Smith

(57) ABSTRACT

An adjustable holder is disclosed for holding a marking material, such as a crayon, comprising an elongated housing with first and second end portions, a hollow cylindrical cavity for housing marking material and a centerline therethrough. A tubular interior portion having a threaded inner bore and an outer wall is coaxially positioned within the housing cavity. A collar adjacent to the first end portion is attached to the housing, rotatable about the centerline. The collar has a hole for insertion of the crayon therethrough. There is provided a device for advancing the tip of the crayon along the longitudinal centerline within the housing. A receptacle portion is coaxially positioned within the tubular interior portion for retentively receiving one end of the crayon. The crayon is rotated by rotation of the collar, which cooperate to linearly traverse the receptacle portion within the tube threaded bore along the centerline. A second advancing device, a slide portion, is attached to the outer wall of the tubular interior portion. The slide portion extends through a slot in the housing and is movably positioned to permit the slide portion to slide in a direction parallel with the centerline and at least a portion of the length of the hollow cavity, the tube having a longitudinal dimension less than that of the cavity.

8 Claims, 5 Drawing Sheets

ADJUSTABLE CRAYON HOLDER

BACKGROUND

A crayon or lumber crayon, is commonly used by craft persons, such as carpenters, loggers, metal workers, lumber graters and others. These workers frequently carry a crayon on their person in order to mark dimensions, instructions, cutting lines and other information on a work piece. Frequently field conditions and the general environment are rough. The crayons must be stored in tool pouches, pockets, nail bags and the like. The soft crayon material is often broken or ground to small pieces by contact with the nails, tools or other solid items, leaving useless remnants of crayon. Without a holder, the entire crayon is exposed to abuse.

For the foregoing reasons, there exists a need for a rugged-body crayon holder which allows the user to adjust the length of exposed crayon tip and to retract the tip of the crayon when not in use.

SUMMARY OF THE INVENTION

What is disclosed is an adjustable holder for holding a marking means, such as a crayon, comprising an elongated housing with first and second end portions, a hollow cylindrical cavity for housing marking material and a centerline therethrough. A tubular interior portion having a threaded inner bore and an outer wall is coaxially positioned within the housing cavity. A collar adjacent to the first end portion is attached to the housing, rotatable about the centerline. Collar portion has a hole for insertion of the crayon therethrough. There is provided means for exposing the tip of the crayon by advancing the crayon along the longitudinal centerline within the housing. A receptacle portion is coaxially positioned within the tubular interior portion for retentively receiving one end of the crayon. The crayon is rotated by rotation of the collar, which cooperate to linearly traverse the receptacle portion within the tube threaded bore along the centerline.

A second movement means, a slide portion, is attached to the outer wall of the tubular interior portion. The slide portion extends through a slot in the housing and is movably positioned to permit the slide portion to slide in a direction parallel with the centerline and at least a portion of the length of the hollow cavity, the tube having a longitudinal dimension less than that of the cavity.

It is therefore an object of the present invention to provide a plastic device for holding a lumber crayon.

A further object of the present invention is to provide a device in which a crayon is secured within a protective holder by a rubber ring, and the length adjustable by means of a rotatable collar or a thumb slide.

Another object of the present invention is to provide a retractable crayon holder.

Yet another object is to provide a crayon holder which includes a rotating collar that allows a consumer to advance the crayon for use and to retract it for storage.

Another object is to provide an efficient, simple design for ease of operation and manufacturing.

DETAILED DESCRIPTION

Figure 1:
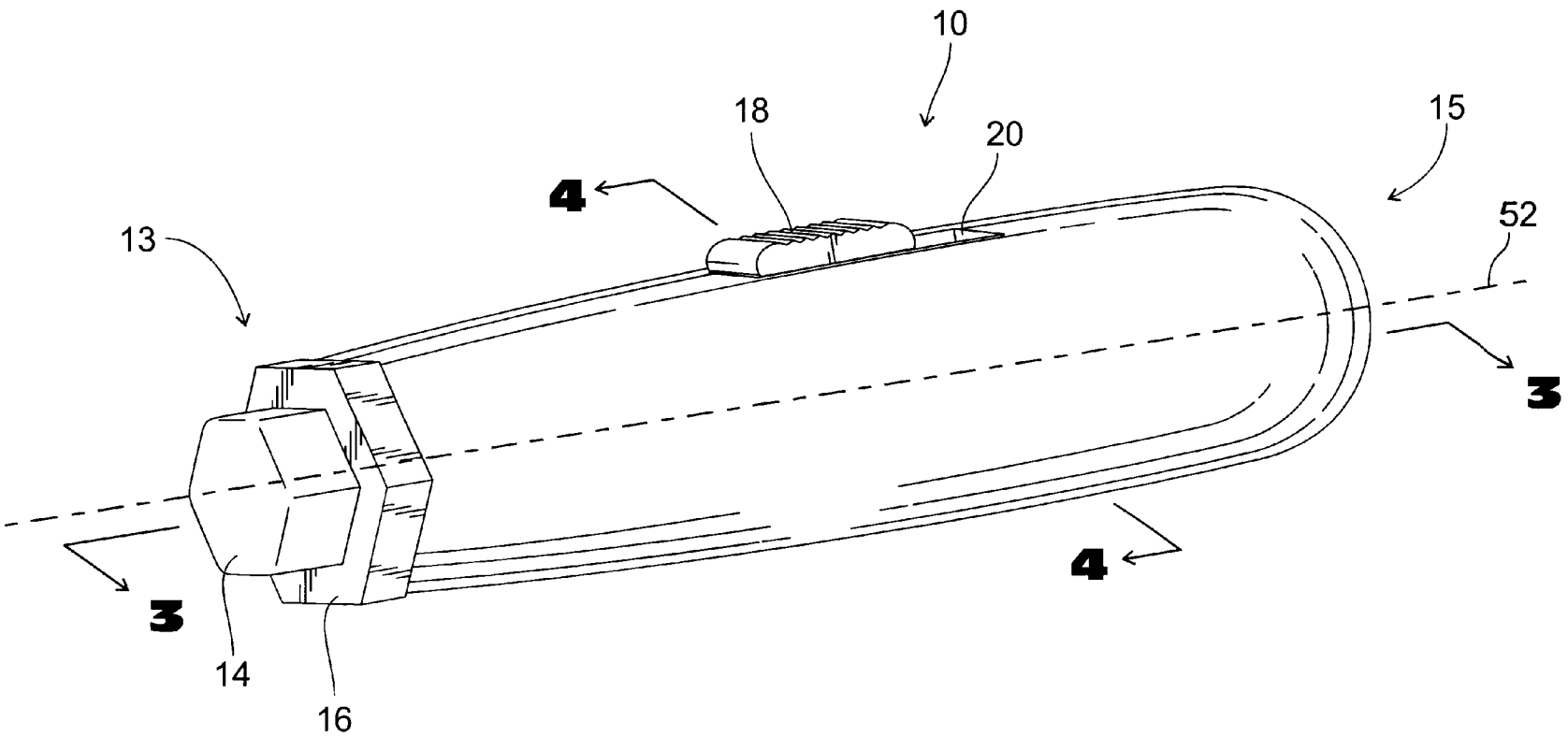
FIG. 1 is a perspective view of the device.
Figure 3:
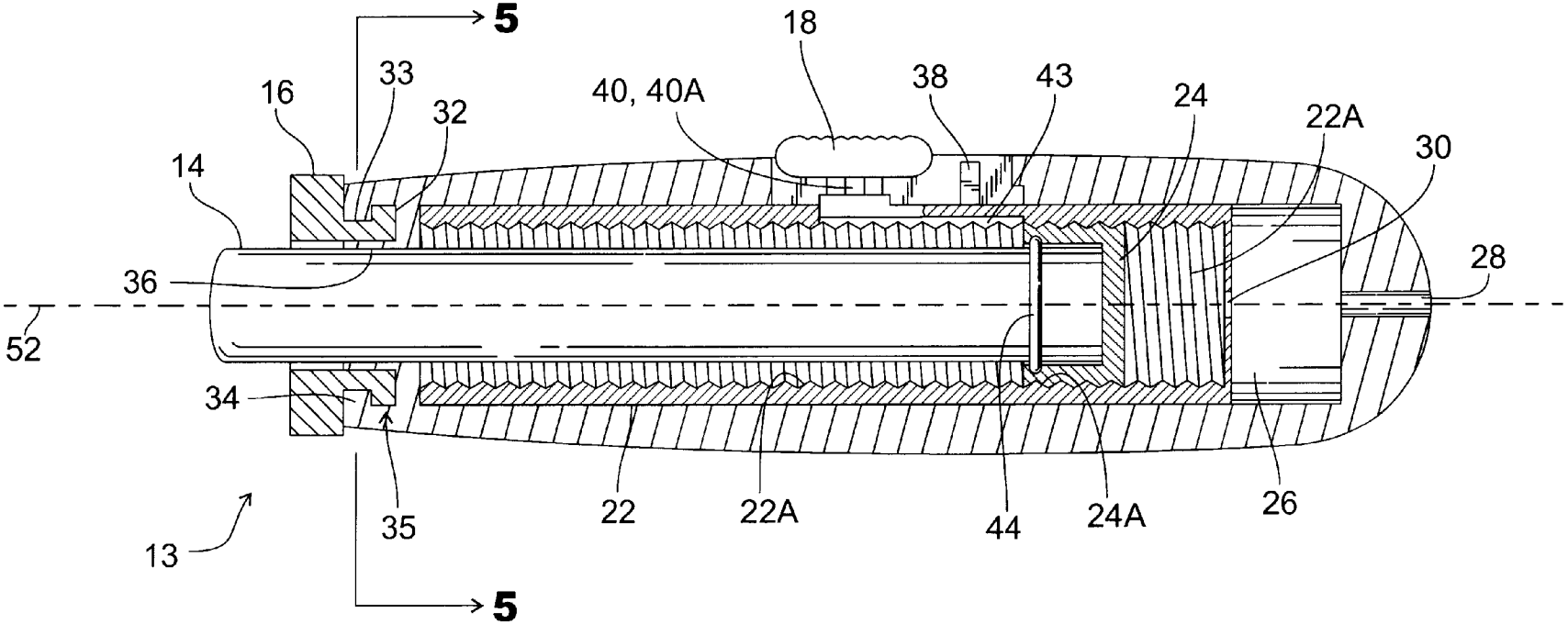
FIG. 3 is a sectional view taken along lines 3—3 of FIG. 1.

Referring now to FIG. 1. an adjustable crayon holder is generally designated as 10 . The elongated housing or body 12 defines a hollow cylindrical cavity and includes first end portion 13 and second end portion 15, with a slot 20 in the top. Slot 20 is provided to accept thumb slide 18 connected to a tubular portion 22. A crayon 14 having a hexagonal cross-section is inserted into end portion 13. Collar 16 is rotatable about centerline 52. As shown in FIG. 3, hexagonal portion of collar 16 is attached by means of housing sleeve 36 to a circular collar flange 32 which projects radially outward into groove 35 in housing 12. The groove is formed by a shelf 34 at first end portion 13 of body 12. Shelf 34 projects radially inward towards sleeve 36 to retentively position said hexagonal end portion if collar 16 between shelf 34 and sleeve 36, so that flange 32 may rotate freely within groove 35.

Figure 2:
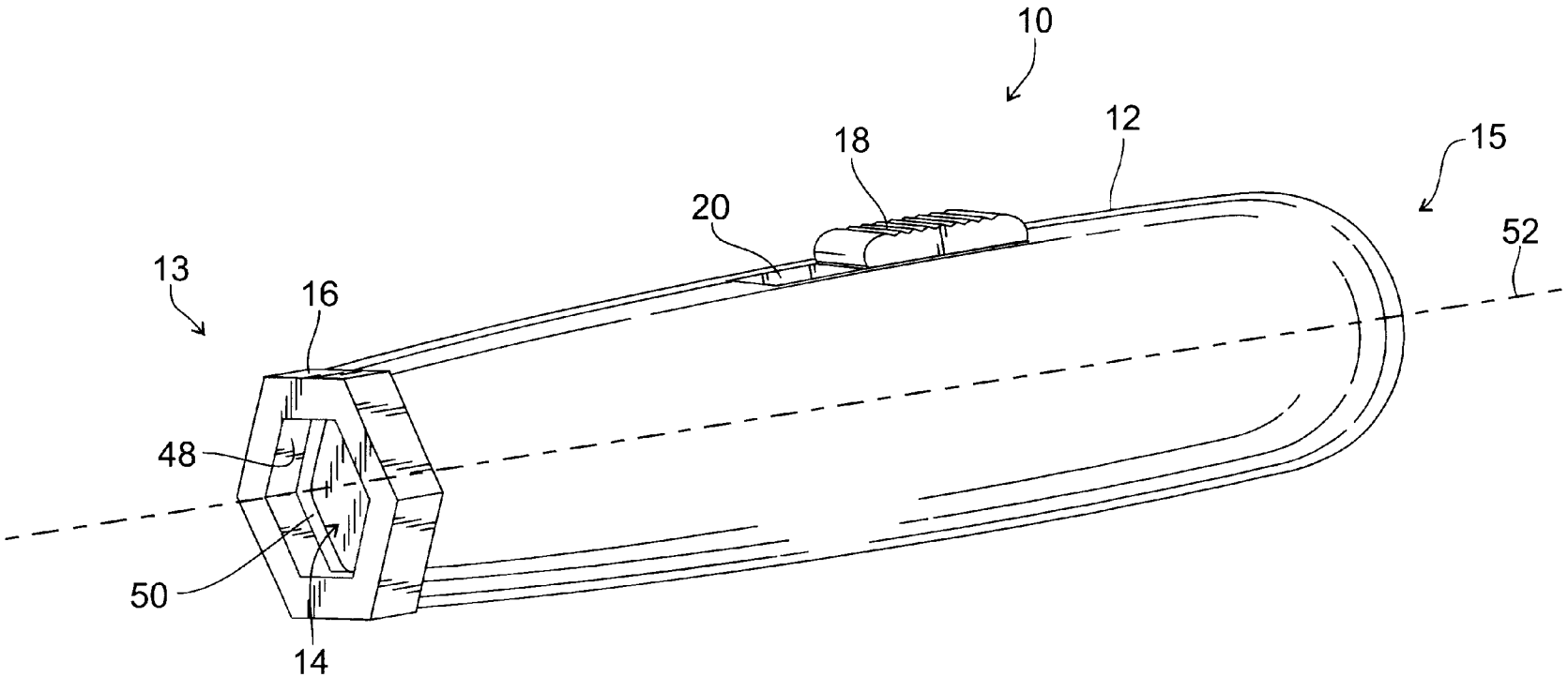
FIG. 2 is an alternate perspective view in which showing the thumb slide in a retracted position.

Referring now to FIG. 2, the crayon holder 10 is shown in a retracted position. Crayon 14 is entirely encased within housing or body 12. Thumb slide 18 is shown in the extreme rear portion of slot 20 indicating the crayon 14 is in the retracted position. Opening or hole 50 is used to insert the crayon 14 into threaded cup or receptacle portion 24 which is coaxially positioned with the tubular portion 12. The inner surfaces 48 of the hexagonal opening 50 defined the octagonal frame of collar 16 which engages crayon 14 when crayon 14 is extended into or through opening 50. The engagement with inner surface 48 allows the rotation of crayon 14, which in turn, as is more evident from FIG. 3, rotates threaded cup 24 within tubular portion 22 to advance or retract the length of crayon 14 which is exposed outside of holder 10.

Referring again to FIG. 3, a sectional view taken along lines 3—3 in FIG. 1 illustrates a cross-sectional view of holder 10. At one end 13 shown at the left side of FIG. 3 a rotatable collar is maintained in position by collar flange 32. The shelf 34 of housing 12 contacts collar flange 32, between housing sleeve 36, to retain collar 16 adjacent to housing 12. The perimeter of collar flange 32 is circular as opposed to the hexagonal perimeter shape of collar 16. The circular perimeter of flange 32 permits rotational movement within groove 35, which is also circular to accommodate the circular collar flange 32. Neck portion 33 is an annular portion extending from collar 16 to connect collar flange 32. As seen in FIG. 3, opening 50 is the end through which crayon 14 extends beyond collar 16, exposing, a portion of crayon for which the individual will use for marking.

The opposite end of crayon 14 is inserted into threaded cup 24. Rubber ring 44 sits within a partial notch which is designed to hold rubber ring 44 in place while crayon 14 is inserted into cup 24, resulting in a frictional fit between rubber ring 44 and crayon 14 sufficient to prevent the crayon from sliding forward along axis 52 and out of cup 24. The interior recess of threaded cup 24 is shaped in a hexagon, corresponding to collar 16, so as to accommodate the shape of crayon 14 as well. The external side wall of threaded cup 24, contains threads which are engaged with the threaded interior of tubular portion 22. By extending the crayon through opening 50 and into threaded cup 24, rotating collar 16 operates to rotate threaded cup 24 within the threads of tubular portion 22 to either extend or shorten the exposed portion of crayon 14. This is accomplished by the engagement of crayon 14 with inner wall surfaces 48 of collar 16. An adjustment opening 28 is provided at end 15 opposite from collar 16. Opening 28 exposes slot 30 in the end of tubular portion 22. Slot 30 accepts a screwdriver or other similar tool, to permit the rotation of tubular portion 22 within cavity 26. Alignment of threaded cup 24 with the hexagonal opening 50 in collar 16 is thereby accomplished, so as to permit crayon 14 to be inserted into threaded cup 24 in proper alignment. Preferably, adjustment of the exposed portion of crayon 14 is accomplished while thumb slide 18 is in the forward, non-retracted position. Thus, once a desirable length of crayon 14 is selected, thumb slide 18 may be used to retract crayon 14 by movement of the entire threaded tubular portion 22 within cavity 26. This movement is achieved by depressing thumb slide 18 to deflect armature 42 downward, releasing tab 40 from slot 40*a*. While thumb slide 18 is depressed, tab 40 is released from notch 40*a*, permitting transverse movement, whereby movement of thumb slide 18 towards the right end of slot 20 permits the alignment of notch 38 with tab 40. Release of pressure from thumb slide 18 permits armature 42 to apply spring pressure upward into notch 38 and retain thumb slide 18 in the retracted position, the distance of retraction being equal to the distance between notch 40*a* and notch 38. This distance should be greater than or equal to the length of crayon 14 which is exposed, in order that the movement of thumb slide from notch 40*a* to notch 38 will retract essentially all of crayon 14, leaving little or no crayon 14 exposed. In order to permit the deflection of armature 42, it is necessary that an air gap 43 be provided along a side of threaded tubular portion 22, adjacent slot 20. Air gap 43 permits the downward deflection of armature 42 in order to release tab 40, thereby permitting slidable movement and re-engagement with notches 38,40*a*. Threads 22*a* internal to threaded tubular portion 22, mesh with external threads 24*a* of threaded cup 24 for finer adjustment of the exposed length of crayon 14. It is a further requirement that cavity 26 have a longitudinal dimension greater than threaded tubular portion 22 along center line or axis 52, in order to provide sufficient movement within cavity 26 of tubular portion 22, to retract thumb slide 18 at least the distance between notches 38 and 40*a*. Thus, the minimum length of cavity 26 must be equal to the length of tubular portion 22 plus the retractable distance defined as the distance between notches 38 and 40*a*.

Figure 4:
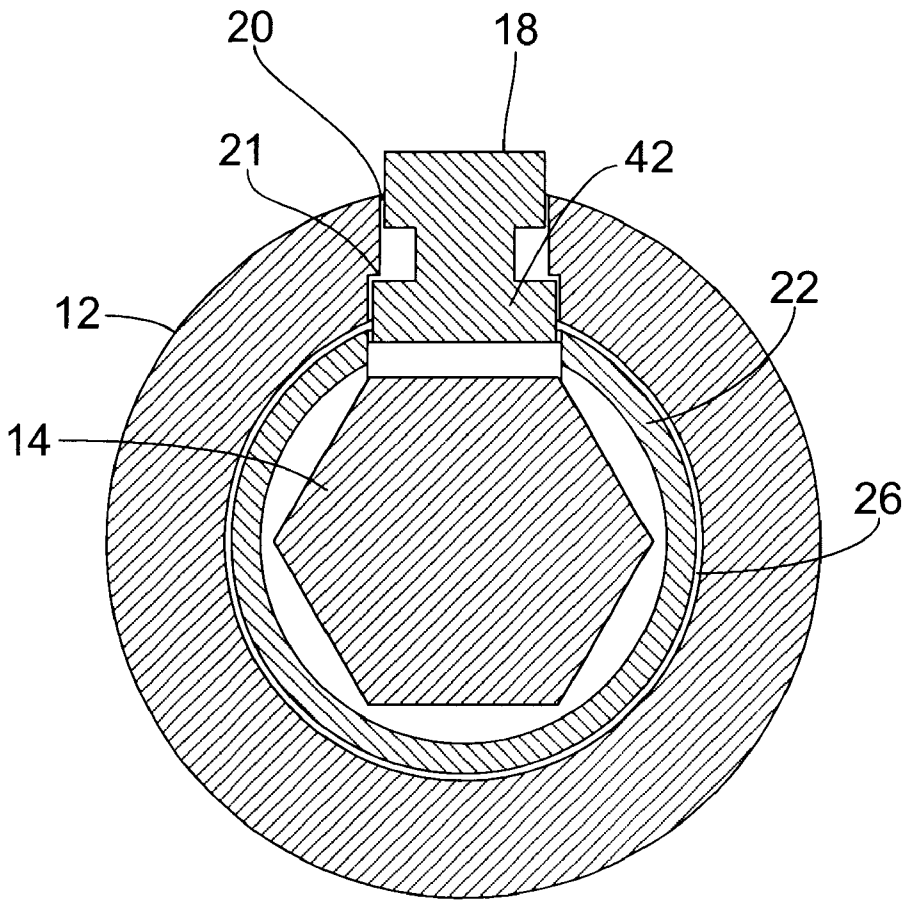
FIG. 4 is a sectional view taken along lines 4—4 of FIG. 1.
Figure 6:
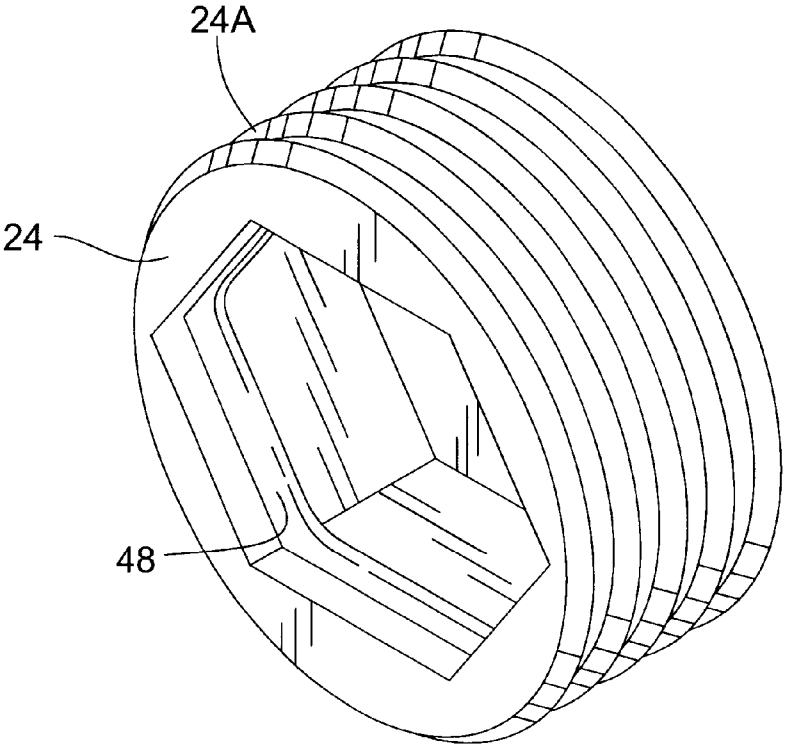
FIG. 6 is a perspective view of threaded cup 24.
Figure 5:
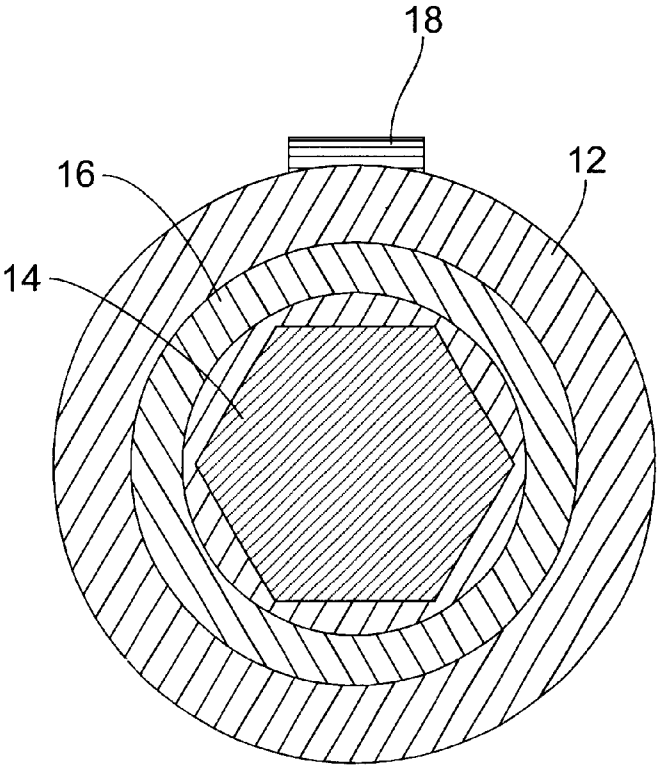
FIG. 5 is a sectional view taken along lines 5—5 of FIG. 3.

Referring now to FIG. 4, a cross sectional view taken along the lines 4—4 in FIG. No. 1, the tolerances between crayon 14, body 12, and thumb slide 18 become apparent. The crayon 14 at this point of cross-section is supported by collar 16, and threaded cup 24. Threaded tubular portion 22 fits within cavity 26 of body 12. The interior surface of body 12 and exterior surface of tubular portion 22 are circular and smooth, so as to allow free slide movement along the longitudinal axis 52. However, the gap between them should be sufficiently minimal so as to achieve a slight friction fit in order to retain alignment and avoid relative axial movement between the crayon 14 and collar 16 which may tend to deform or otherwise harm the crayon material. Also illustrated in FIG. 4 is a ridge 21 formed in slot 20, which abuts armature 42 and prevents armature 42 from extending beyond ridge 21 into opening 20.

In the foregoing description, a hexagonal cross-sectional geometry of the crayon is described. This is a common shape for crayons utilized in the industry. However, it is readily apparent that any two-dimensional cross-section may be used (with the possible exception of a circular crayon and opening.) For example, an oval shaped crayon, or a circular arrangement with a partially flat side, when inserted through a complementary shaped opening, will be capable of rotation by the collar 16. Further, the perimeter shape of collar 16 need not be the same as the opening 50, although it is shown that way in the preferred embodiment to facilitate manufacturing.

According to the provisions of the patent statutes, I have explained the principle, preferred construction and mode of operation of my invention and have illustrated and described what I now consider to represent its best embodiments. However, it should be understood that within the scope of the appended claims, the invention may be practiced otherwise than as specifically illustrated and described.

I claim:

1. An adjustable holder for holding a marking material comprising:

an elongated housing having a first and second end portions, a hollow cylindrical cavity for housing the marking material, and a centerline therethrough;

a tubular interior portion coaxially positioned within said hollow cavity, having a threaded inner bore, and an outer wall:

a collar adjacent to said first end portion, said collar being attached to said housing rotatably about said centerline, and having a hole for insertion of said marking material there through; and at least one means for advancing said marking means along said longitudinal centerline within said housing.

2. The adjustable holder for holding a marking material as set forth in claim 1, wherein:

said at least one means for advancing said marking material comprises a receptacle portion positioned coaxially within said tubular interior portion for retentively receiving one end of said marking material such that said marking material when rotated within said hole in said collar cooperates to linearly traverse said receptacle portion within said threaded bore of said tubular portion along said centerline.

3. The adjustable holder for holding a marking material as set forth in claim 2, wherein said second end portion also has an adjustment opening coaxial with the centerline, and said receptacle portion having a slot facing said second end portion such that an implement may be inserted through said adjustment opening into said slot for aligning the receptacle portion with said hole in said collar hole.

4. The adjustable holder for holding a marking material as set forth in claim 2, wherein said receptacle portion also has an open end and a closed end and a recess adjacent said open end, and a rubber ring partially engaging said recess and said marking material to frictionally maintain said material means within said receptacle portion.

5. The adjustable holder for holding a marking material as set forth in claim 1, wherein:

said at least one means for advancing said marking material comprises a slide portion attached to said outer wall of said tubular interior portion, said slide portion extending through a slot in said housing and being movably positioned to permit said slide portion to slide in a direction parallel with the centerline and at least a portion of the length of said hollow cavity, said tubular portion having a longitudinal dimension less than that of the cavity.

6. The adjustable holder for holding a marking material as set forth in claim 3, further comprising a deflecting armature on said slide portion, said armature having at least one tab portion projecting outward, and wherein said slot in said housing includes at least one notched recess which cooperates with said tab portion when said armature is deflected and said slide portion is moved along the length of the slot to engage said notched recess.

7. The adjustable holder for holding a marking material as set forth in claim 1, wherein:

said collar also comprising a hexagonally shaped perimeter, said hole having hexagonal shaped inner wall surfaces connected with a circular collar flange, said circular collar flange extending radially into a groove located adjacent to said first end portion within said housing.

8. The adjustable holder for holding a marking material as set forth in claim 1, said housing having a configuration to facilitate gripping of said holder.

* * * * *